US006371605B1

(12) United States Patent
Komplin et al.

(10) Patent No.: US 6,371,605 B1
(45) Date of Patent: Apr. 16, 2002

(54) INK JET PRINTER INK CARTRIDGE MANUFACTURING METHOD

(75) Inventors: Steven R. Komplin; Gerald F. Davis, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/813,679

(22) Filed: Mar. 21, 2001

(51) Int. Cl.[7] ..... B41J 2/175
(52) U.S. Cl. ..... 347/86
(58) Field of Search ..... 347/85, 86, 87; 156/580, 583.1

(56) References Cited

U.S. PATENT DOCUMENTS

| | | | | |
|---|---|---|---|---|
| 3,963,813 A | | 6/1976 | Keith | 264/167 |
| 4,625,373 A | | 12/1986 | Duffield et al. | 29/25.35 |
| 4,856,989 A | | 8/1989 | Siebert | 432/225 |
| 4,935,751 A | * | 6/1990 | Hamlin | 347/86 |
| 5,066,351 A | | 11/1991 | Knoll | 456/212 |
| 5,359,356 A | | 10/1994 | Ecklund | 347/86 |
| 5,467,118 A | | 11/1995 | Gragg et al. | 347/87 |
| 5,574,489 A | | 11/1996 | Cowger et al. | 347/86 |
| 5,857,952 A | | 1/1999 | Gilbert | 493/218 |
| 5,896,151 A | * | 4/1999 | Miyazawa et al. | 347/86 |
| 5,917,523 A | | 6/1999 | Baldwin et al. | 347/85 |
| 5,984,463 A | | 11/1999 | Kozmiski et al. | 347/87 |
| 6,119,371 A | | 9/2000 | Goodwin et al. | 36/29 |
| 6,145,970 A | | 11/2000 | Sasaki et al. | 347/85 |

FOREIGN PATENT DOCUMENTS

DE 4112346 10/1992

* cited by examiner

*Primary Examiner*—Anh T. N. Vo
(74) *Attorney, Agent, or Firm*—Luedeka, Neely & Graham, P.C.

(57) ABSTRACT

The invention provides an improved ink jet cartridge for an ink jet printer and a method for making the improved ink jet cartridge. The method includes providing a thermoplastic, flexible web having an edge portion, a first side and a second side and providing a substantially inflexible frame member having at least one peripheral edge. Disposing the first side of the flexible web adjacent the peripheral edge of the frame, thereby defining a substantially closed cavity. Heat welding the edge portion of the web and peripheral edge of the frame to one another using a heated platen using a heat welding structure and conditions which minimize thinning of the flexible web on the bonding surface at least adjacent the substantially closed cavity. Minimizing the thinning of the flexible web adjacent the closed cavity substantially improves the weld and resulting reliability of the ink cartridge.

29 Claims, 6 Drawing Sheets

INK JET PRINTER INK CARTRIDGE MANUFACTURING METHOD

TECHNICAL FIELD

This invention relates to the field of ink jet printers. More particularly, this invention relates to an improved ink jet printer cartridge and a manufacturing method therefor.

BACKGROUND OF THE INVENTION

Ink jet printers require an ink supply to be in fluid contact with an ink drop ejecting device which precisely ejects ink onto a recording media. The ink supply must be maintained at a relatively constant pressure to keep the ink from discharging from the ejecting device at the wrong time or in an undesired amount. There are several methods and devices for maintaining a constant negative back-pressure including capillary fibers or foam, bladder-type configurations and lung-type configurations.

Bladder and lung configurations are preferred since they may be configured to provide a smaller volume ink reservoir for the same quantity of ink contained in a foam or fiber filled reservoir. Such bladder and lung devices may consist of a rigid frame with either one or two side panels made of a thin plastic laminate material. Both configurations depend on a flexing of the side panels which is resisted by a biasing member located either between the side panels (bladder configurations) or between one of the side panels and a rigid panel attached to the frame (lung configurations). The side panels are typically heat welded or adhesively attached to a substantially rigid frame. While heat welding is an effective, less time consuming and less costly method of attaching the flexible panels to a rigid frame, improvements in heat welding techniques are needed to increase useable product yield and provide a less fragile lung or bladder construction.

SUMMARY OF THE INVENTION

The foregoing and other needs are provided by an improved ink cartridge for an ink jet printer and improved manufacturing method therefor. According to the invention, a method for manufacturing a pressure control device for an ink jet cartridge is provided. The method includes providing a thermoplastic, flexible web having an edge portion, a first side and a second side and providing a substantially inflexible frame member having at least one peripheral edge. The first side of the flexible web is disposed adjacent the peripheral edge of the frame, thereby defining a substantially closed cavity. The edge portion of the web and peripheral edge of the frame are heat welded to one another using a heated platen, the heated platen having a heating surface and the peripheral edge having a bonding surface. The heat welding step is preferably conducted with a structure selected from the group consisting of an angled platen for heat welding the web and peripheral edge, a conventional platen for heat welding an angled peripheral edge and an angled platen for heat welding an angled peripheral edge whereby a bond is formed between the flexible web and the bonding surface at a temperature and pressure which minimizes thinning of the flexible web on the bonding surface at least adjacent the substantially closed cavity and wherein an angle providing the angled platen or angled peripheral edge relative to a plane defined by the flexible web ranges from about 5 to about 45 degrees.

In another aspect the invention provides an ink jet pen for use in an ink jet printer. The pen includes an ink jet cartridge body and ink jet cartridge attached to the cartridge body. The ink jet cartridge contains ink and a pressure control device is disposed therein for maintaining a substantially constant pressure in the ink jet cartridge. The ink jet cartridge includes a substantially inflexible frame having at least one peripheral edge. At least one thermoplastic, flexible web is provided having an edge portion, a first side and a second side. The edge portion of the first side of the flexible web is heat welded to the peripheral edge of the frame thereby defining a substantially closed cavity. The edge portion and peripheral edge are heat welded to one another at a temperature and pressure sufficient to provide a reinforced web edge portion. The heat welded flexible web is preferably provided by a heat welding structure selected from the group consisting of an angled platen for heat welding the web and peripheral edge, a conventional platen for heat welding an angled peripheral edge and an angled platen for heat welding an angled peripheral edge and wherein an angle providing the angled platen or angled peripheral edge relative to a plane defined by the flexible web ranges from about 5 to about 45 degrees.

By heat welding the edge portion of the flexible web and peripheral edge of the frame to one another with an angled heated platen, an angled peripheral edge, or both an angled platen and angled peripheral edge, the edge portion of the web is substantially reinforced with respect to the frame. As compared to a pressure control device for an ink jet cartridge made with a standard, non-angled platen and/or peripheral edge, the pressure control device made according to the invention withstands mishandling to a greater degree thereby providing a higher yield of usable parts. The ink cartridges containing such pressure control devices are also substantially more reliable for long term use due to less thinning of the web edge portion adjacent the closed cavity during the welding or bonding process.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

Figure 1:
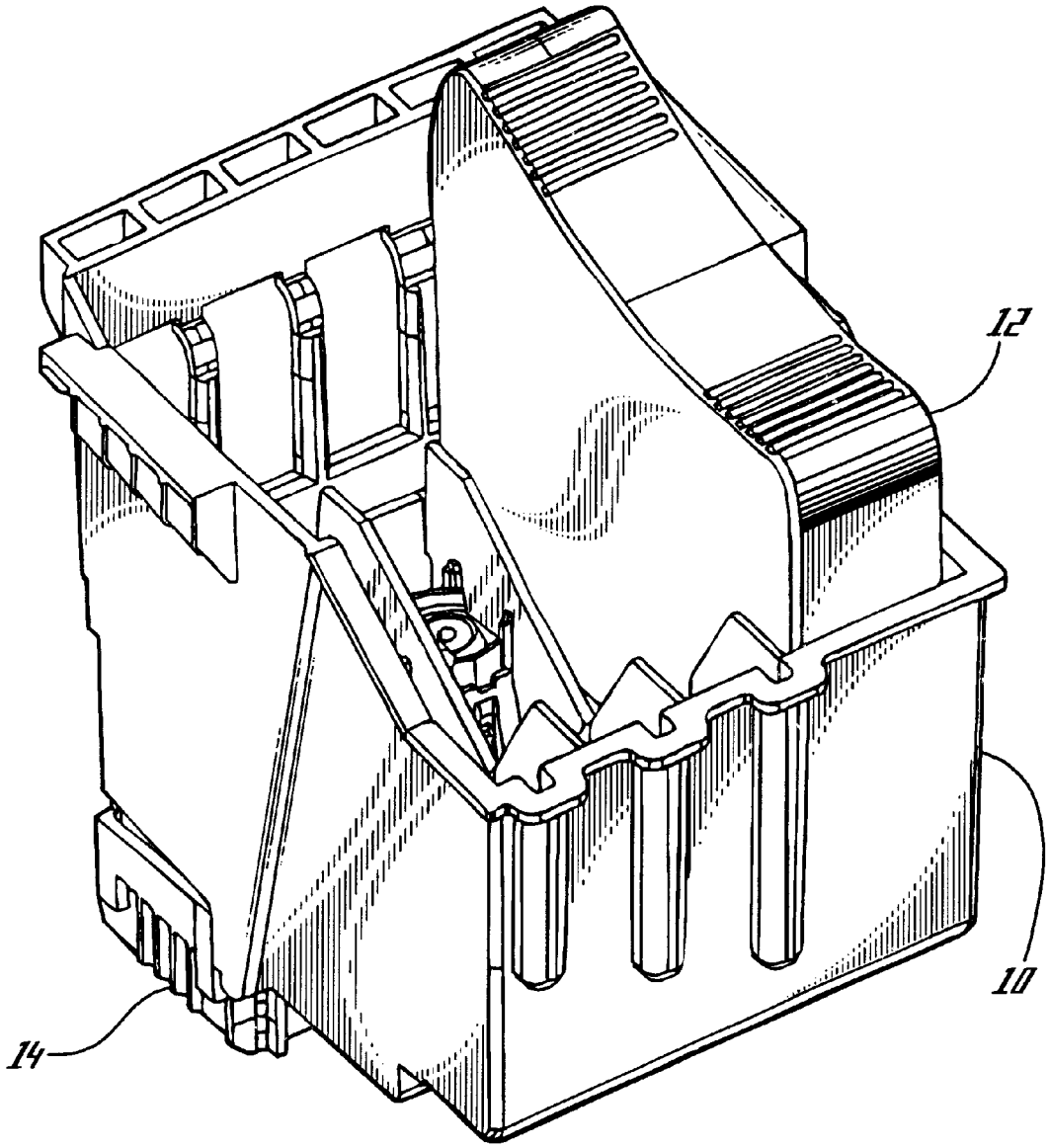
FIG. 1 is a perspective view of a cartridge body containing an ink jet cartridge according to the invention.
Figure 2:
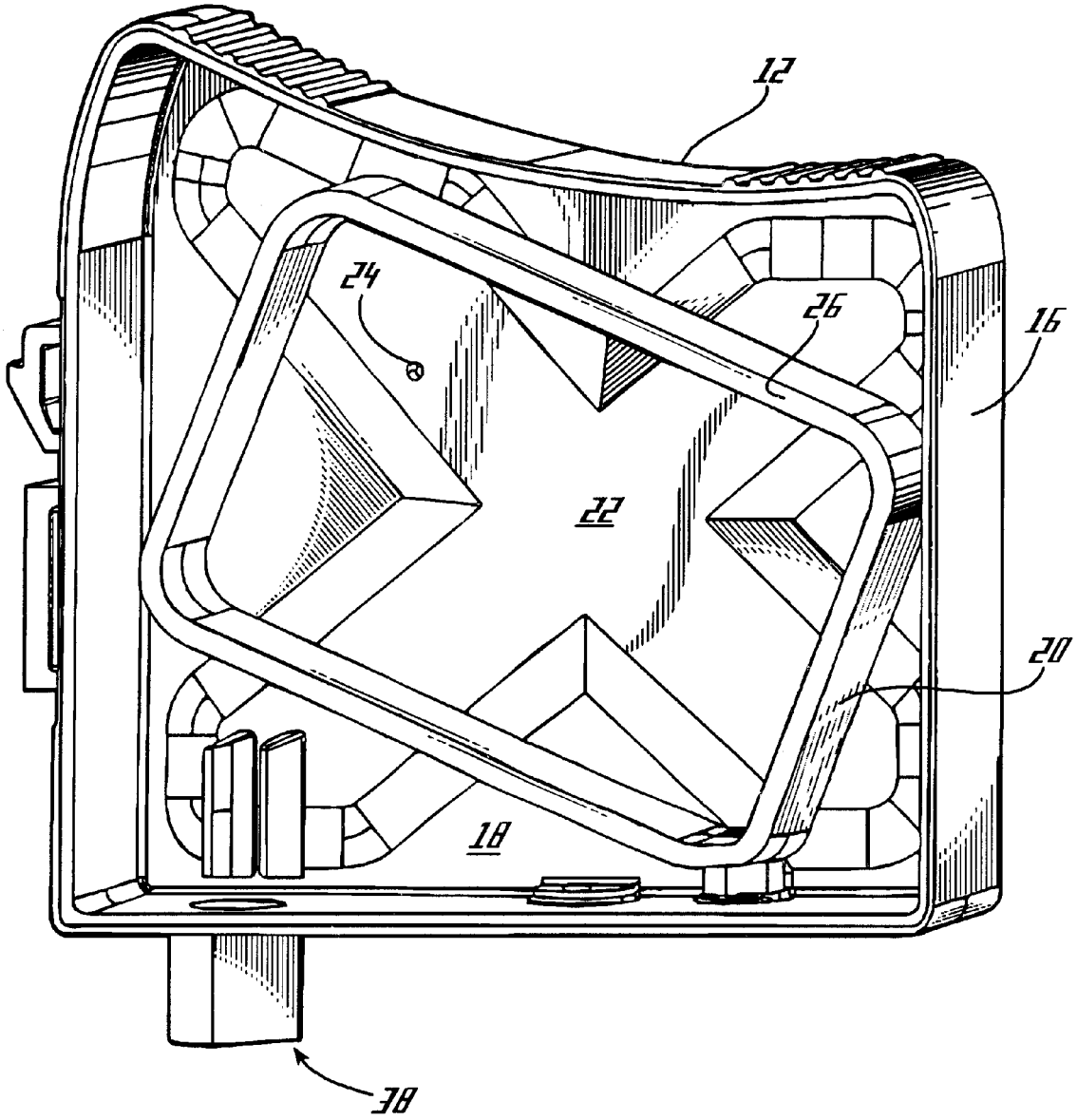
FIG. 2 is a side perspective view of a portion of an ink cartridge according to the invention.

DETAILED DESCRIPTION OF THE INVENTION:

With reference now to FIGS. 1 and 2 there is shown a perspective view of an ink cartridge body 10 containing an ink cartridge 12 for an ink jet printer according to the invention. The ink cartridge body 10 contains at least one ink cartridge 12, and preferably multiple ink cartridges 12 for providing ink to ink jet printheads attached to the cartridge body 10 for ink ejection onto recording medium, such as paper. The ink jet printheads are attached to an opposing side 14 of the cartridge body 10 to which ink jet cartridge 12 containing ink is attached. The cartridge body 10 is attached to a carriage in the printer for moving the print head across a print media The ink jet cartridge 12 will be further broken down into respective components and described in greater detail below.

Figure 3:
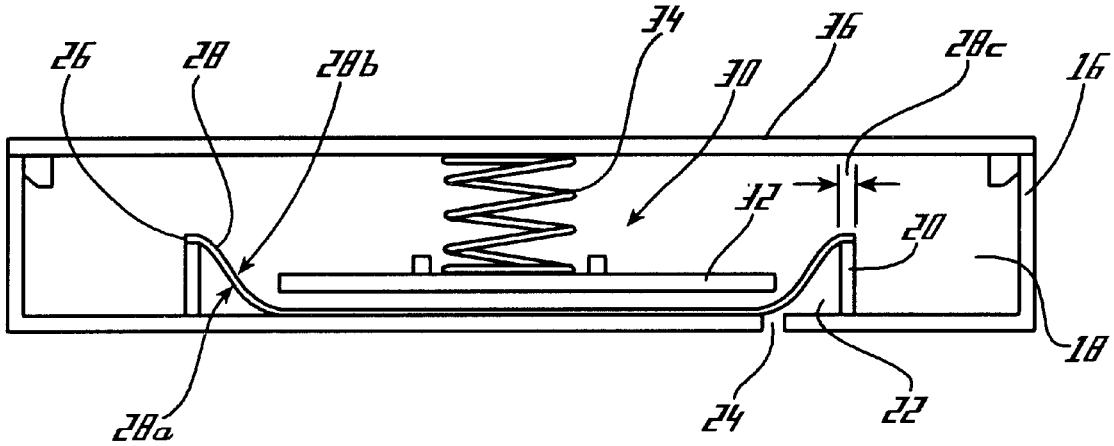
FIG. 3 is a side cross-sectional view, not to scale, of a lung-type pressure control device in an ink cartridge according to the invention.

Referring to FIG. 2, ink jet cartridge 12 contains a substantially inflexible outer frame 16 defining an ink cavity 18 and a substantially inflexible inner frame 20 defining a pressure control cavity 22 containing at least one pressure control port 24 wherein a pressure differential may exist between the pressure control cavity 22 and the ink cavity 18. As shown in FIGS. 2 and 3, pressure port 24 provides fluid communication between the cavity 22 defined by inner frame 20 and atmospheric pressure external to the ink jet cartridge 12.

Referring again to FIG. 2, the inner and outer frames 20 and 16 respectively of the ink cartridge 12 are preferably constructed of a substantially rigid thermoplastic materials. The inner frame 20 further includes at least one peripheral edge 26. Peripheral edge 26 provides an attachment surface for a pressure control member as described in more detail below.

As shown in FIG. 3, at least one thermoplastic, flexible web 28 is provided for attaching to the peripheral edges 26. The flexible web 28 has a first side 28*a* and a second side 28*b*. The web 28 may be a mono-layer film, metallized film or a plastic laminate comprised of laminar layers of material. The material layers may be selected from the group of polymeric materials consisting of polyvinylidene chloride, polyethylene, polypropylene, polyamide, and polyethylene teraphthalate, and combinations of two or more of the foregoing, as well as metallized films or films containing silicon oxide coatings made with the foregoing polymeric materials. Other materials which may be used for web 28 include films typically used in the packaging or medical industry.

If a laminate containing two or more polymeric layers is used as the flexible web 28, the laminate is preferably composed of materials with plastic deformation temperatures which are relatively close to one another such as polyamide, polyethylene or polypropylene. Having close laminate deformation properties enables the laminate to be molded or otherwise configured, resulting in a substantially uniform end product. As seen in FIG. 3, an edge portion 28*c* of the first side 28*a* of web 28 is attached to the peripheral edge 26 of the inner frame 20 and together define the substantially closed pressure control cavity 22.

After attaching the web 28 to cavity 22 and conforming the film to the cavity 22, described in more detail below, a biasing member 30 including a substantially rigid plate 32 and a biasing device 34 selected from a coil spring, leaf spring, foam and the like is placed adjacent the second side 28*b* of web 28. Those skilled in the art will recognize that a variety of biasing devices 34 may be used and FIG. 3 is not intended to limit the invention to the described embodiments. For example, the web 28 may be biased by fluid pressure such as air pressure rather than using biasing member 30 and biasing device 34, or fluid pressure may be used in combination with the biasing member 34, biasing device 34 or both. A substantially rigid cover 36 is then preferably attached the outer frame members 16 of the cartridge 12 by welding, adhesives and the like in order to provide a liquid tight ink cavity 18 with the biasing member 34 between the rigid cover 36 and the web 28. The foregoing web 28 and biasing means is commonly referred as a "lung-type" pressure control device. The pressure control device maintains a substantially constant pressure in ink cavity 18 so that the flow of ink to the printheads through ink outlet port 38 is relatively constant during printing operations and changing atmospheric conditions.

Figure 4:
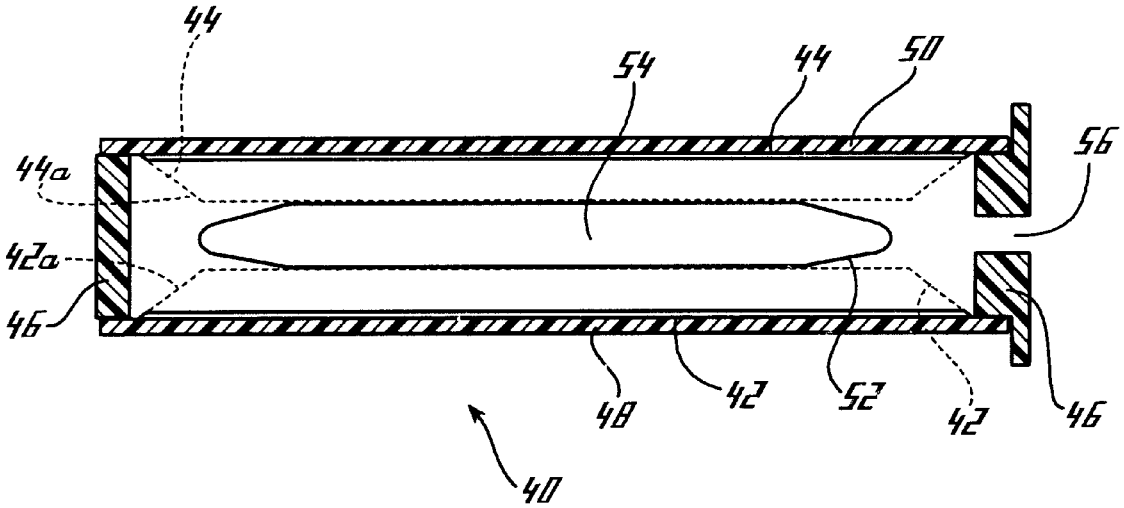
FIG. 4 is a cross-sectional view, not to scale, of a bladder-type pressure control device for an ink cartridge according to the invention.

Referring now to FIG. 4, an ink cartridge 40 containing a "bladder-type" pressure control configuration according to the present invention is illustrated. The foregoing description applies equally well to the bladder-type pressure control device with the distinction that for the bladder-type configuration, two thermoplastic, flexible webs 42 and 44 are attached to a substantially rigid frame 46. The cartridge 40 also contains rigid covers 48 and 50 to protect the webs 42 and 44. In the alternative, one of the webs 42 or 44 may be replaced by a rigid wall.

As shown, in a preferred embodiment of the invention, a biasing means such as biasing member 52 is located adjacent the first sides 42*a* and 44*a* of the flexible webs 42 and 44. The biasing member 52 is preferably a biasing structure or device provided by a body having elastic recovery properties such as a leaf spring, coil spring and a resilient foam which compresses in response to a compressive force and recovers to its uncompressed dimension when the compressive force is removed. Those skilled in the art will recognize that a variety of equivalent biasing members 52 may be used in the alternative embodiment and FIG. 4 is not intended to limit the invention to the described embodiments.

Biasing member 52 aids in maintaining a substantially linearly varying subatmospheric pressure within ink cavity 54. Bladder-type configurations normally contain ink within cavity 54 which is between webs 42 and 44. A negative pressure throughout cavity 54 is essential to prevent untimely or unwanted ejection of ink from cartridge 40. A preferred pressure in cavity 54 ranges from about negative 2 to about negative 8 inches of water. As ink in cavity 54 flows through ink outlet port 56 of cartridge 40 during a printing operation, the cavity 54 volume will decrease as shown by broken lines representing webs 42 and 44. Biasing member 52 acts to apply an opposing force to the contracting force of the cavity 54 as ink flows from cartridge 40 to the ink jet pens thereby maintaining a desired subatmospheric pressure in cavity 54.

In the configuration depicted in FIG. 4, a metallized film may also be used as a material for web 44 due to the low vapor transmission rate that metals provide. If a metallized film is used as the webs 42 and 44, it is preferred that the first side 42*a* and 44*a* of the webs 42 and 44 be comprised of a polymeric material, most preferably a thermoplastic polymeric material since this side of the webs 42 and 44 will be exposed to ink.

In the lung type pressure control device described above with reference to FIGS. 2 and 3, the web 28 is preferably heat-sealed to or welded to the peripheral edge 26 of inner frame 20 thereby forming one portion of a hermetically sealed ink cavity 18. In the bladder type pressure control device, the webs 42 and 44 are preferably heat-sealed to or welded to the peripheral edge of frame 46 thereby forming a hermetically sealed flexible ink cavity 54 as described with reference to FIG. 4.

A preferred method for manufacturing pressure control devices for the ink jet cartridges 12 will now be described with reference to FIGS. 5 and 6. For convenience purposes and without desiring to limit the invention in any way, the manufacturing process will be described with respect to a lung type pressure control device as shown in FIGS. 2 and 3. However, the process is also equally applicable to a bladder type pressure control device as shown in FIG. 4. The invention is applicable to ink cartridges 12 attached to a cartridge body 10 as shown in FIG. 1 and to off carriage ink cartridges containing pressure control devices for feed of ink to the ink jet printheads.

According to one embodiment of the invention, a substantially inflexible inner frame 20 is provided. Frame 20 contains at least one peripheral edge 26, which is used as an attachment surface, as described above for web 28. A heated platen 58 is applied to the peripheral edge 26 and edge portion 28*c*(FIG. 3) of the web to heat and/or melt the peripheral edge 26 and edge portion 28*c* thereby forming a bond between the web edge portion 28*c* and the peripheral edge 26 of the frame 20. The platen 58 preferably contains heating members 60 which have an angled heating edge 62. The heating edge 62 is preferably angled with an angle Θ ranging from about 5 to about 45 degrees, preferably from about 10 to about 30 degrees, with respect to a plane defined by the web 28. Accordingly, the angled edges 62, when applied with sufficient heat to melt a portion of the frame 20, provide a beveled frame edge 64. The heating edge 62 is preferably angled to reduce thinning of the edge portion 28*c* of the flexible web 28 during the heat welding step. The angled heating edge 62 enables a non-critical bonding region to be sacrificed to improve the strength of the bond between the web 28 and the frame 20 in a more critical region. An angled heating edge 62 also enables the web 28 to be bonded to the frame 20 at a higher temperature and at a lower pressure thereby improving the bond strength. According to the invention, with a polypropylene web and a polypropylene frame, the heat welding temperature ranges from about 165° to about 185° C. and the heat welding pressure ranges from about 10 to about 30 pounds per square inch (psig) for a period of time ranging from about 2 to about 6 seconds, preferably from about 3 to about 4 seconds.

When a web is heat welded to the frame 20 with the platen 58 described above, the angled edges 62 of the heated platen 58 provide reinforcing or thickened portions 66 of the web 28 on the peripheral edge 26 of the frame adjacent the closed cavity 22 thereby substantially reinforcing the web 28 where the web is attached to the peripheral edge 26 of the frame 20. The thickened portions 66 are adjacent the cavity side 22 of the frame 20 where strength is required because of web flexing. The thickened portions 66 may include melted portions of the frame 20 and/or web 28. The angled platen edges 62 may also provide thickened portions 68 on a portion of the frame 20 exterior to cavity 20. Where the web 28 is attached to the beveled edge 64, the web 28 may be substantially thinner due to melting and flowing of the web 28 during the welding process. However, since the thickened portion 66 is on the peripheral edge 26 between the beveled edge 64 and the cavity 22, the web 28 is substantially stronger as compared to a lung-type pressure control device made with a conventional platen.

Figure 5A:
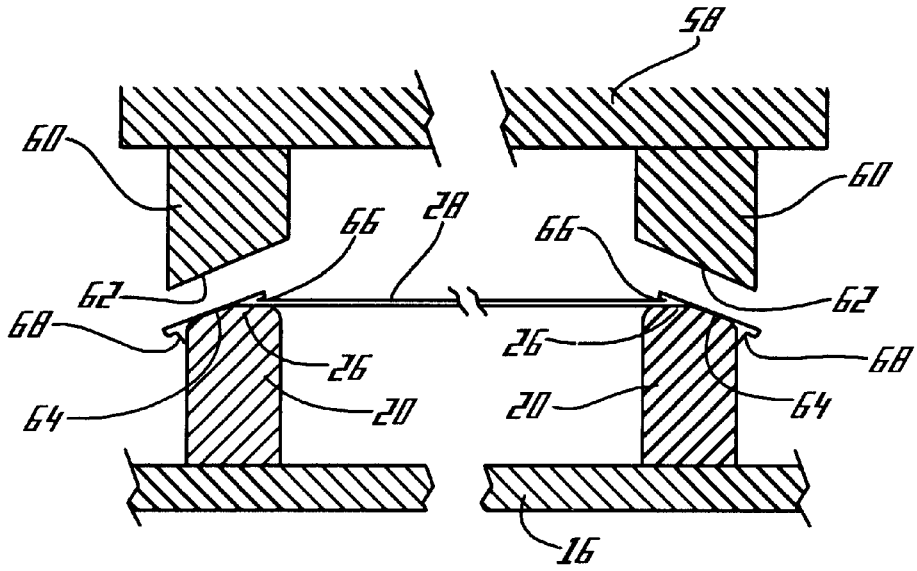
FIG. 5A is a cross-sectional view of a portion of an ink cartridge and a heated platen for welding a flexible web to a cartridge frame according to the invention.
Figure 5B:
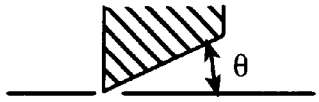
FIG. 5B is a partial cross-sectional view of a heating of a platen for welding a web to a frame according to the invention.
Figure 6:
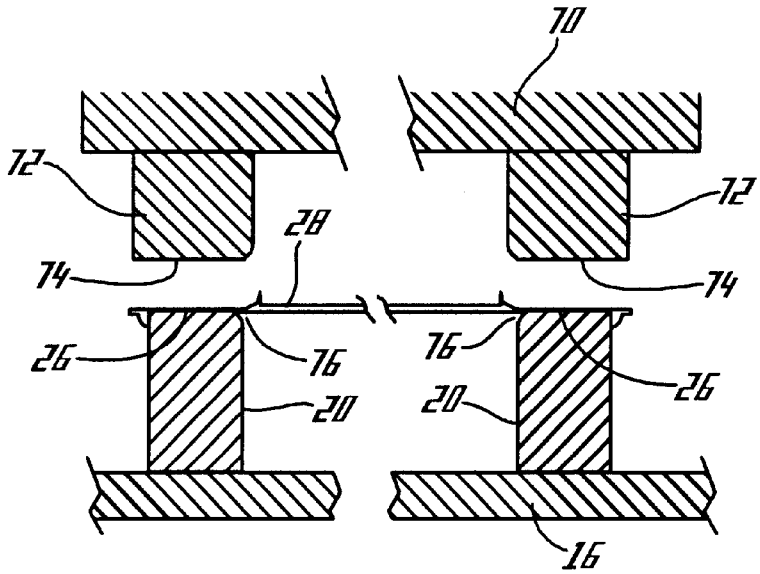
FIG. 6 is a cross-sectional view of a portion of an ink cartridge and a conventional heated platen for welding a flexible web to a cartridge frame.

The differences between a pressure control device made according to the invention and a pressure control device made using a conventional process and platen are illustrated by comparing FIG. 5 with FIG. 6. A conventional heated platen 70 includes heating members 72 containing relatively non-angled heating edges 74. The heating edges 74 are substantially parallel to the plane defined by the web 28. Upon heat welding the web 28 to the peripheral edge 26 of the frame 20, the web 28 is thinned for the entire area of the peripheral edge 26. The conventional platen 70 provides a thin weld zone 76 which is adjacent the cavity 22 thereby substantially reducing the strength of the web 28 in the heat welded area. Because the peripheral edge 26 may not be exactly orthogonal to the frame 20, the flexible web 28 may include even thinner areas due to flattening of the peripheral edge 26 during the welding process. During the conventional process for welding a polypropylene film to a polypropylene web, a pressure of about 100 to about 250 psig and a platen temperature of about 145° to about 155° C. is used for about 3 to about 4 seconds. However, the lung-type pressure control device made with a conventional heated platen 70 exhibits a higher failure rate due to mishandling of the ink cartridges 12 containing the pressure control device.

A reliability comparison was made between lungs made with a conventional platen and those made according to the invention. Ink cartridges containing lungs with webs 28 heat welded to a frame 20 using a conventional platen were dropped to the floor in an unprotected manner. The failure rate of parts due to tearing of the web 28 adjacent the welded areas indicated a failure rate of about 50% when the parts were dropped a distance of 36 inches to the floor. The failure rate of parts made with a conventional platen was about 100% when the parts were dropped a distance of 48 inches to the floor. Some of the parts even failed when dropped a distance of 18 inches to the floor. In comparison, parts made using the angled platen to weld the web 28 to the frame 20 were dropped a distance of 60 inches to the floor without exhibiting tearing or failure of the web 28 or heat welded portions of the web 28.

Figure 7:
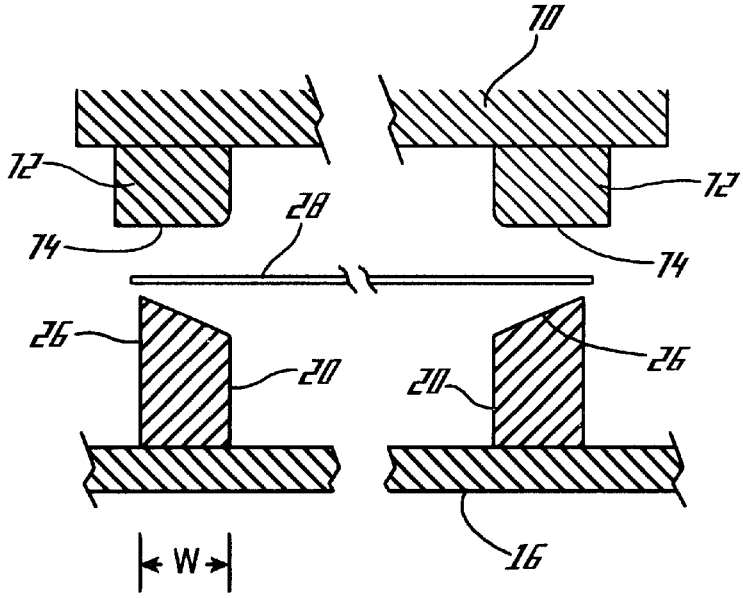
FIG. 7 is an exploded cross-sectional view of a portion of an ink cartridge, heated platen and flexible web according to another embodiment of the invention.

In another embodiment of the invention, illustrated in FIG. 7, a conventional heated platen 70 is used as described above with reference to FIG. 6. However, the peripheral edges 26 of the frame 20 are preferably angled with respect to a plane defined by the flexible web 28. The peripheral edge 26 preferably has an angle Θ ranging from about 5 to about 45 degrees, most preferably about 10 to about 30 degrees with respect to the plane of the web 28. The angle Θ of the peripheral edge 26 selected to provide improved bonding is dependent on the width W of the frame 20. Wider frames 20 may be provided with the smaller preferred angles and narrower frames 20 may be provided with the larger preferred angles which are sufficient to minimize thinning of the web 28 in the edge portions 28*c* adjacent the cavity 22 as described above.

Figure 8A:
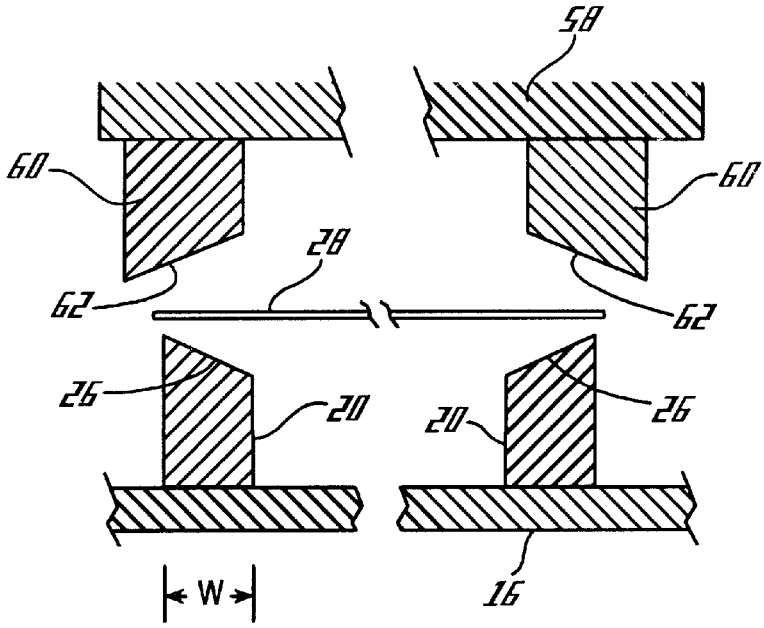
FIGS. 8A–8C are an exploded cross-sectional views of portions of an ink cartridge, heated platen and flexible web according to another embodiment of the invention.
Figure 8B:
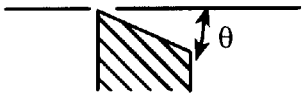
Figure 8C:
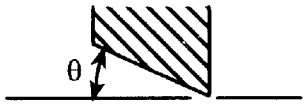

In yet another embodiment illustrated in FIG. 8, the platen 58 contains angled heating edges 62 and the frame 20 contains angled peripheral edges 26 wherein both angles Θ range from about 5 to about 30 degrees, so that the sum of the angles Θ preferably ranges from about 10 to about 30 degrees with each individual angle Θ being with respect to the plane defined by the flexible web. The angles Θ of the heating edges 62 and the peripheral edges 26 are selected as described above depending on the width W of the frame 20.

Figure 9:
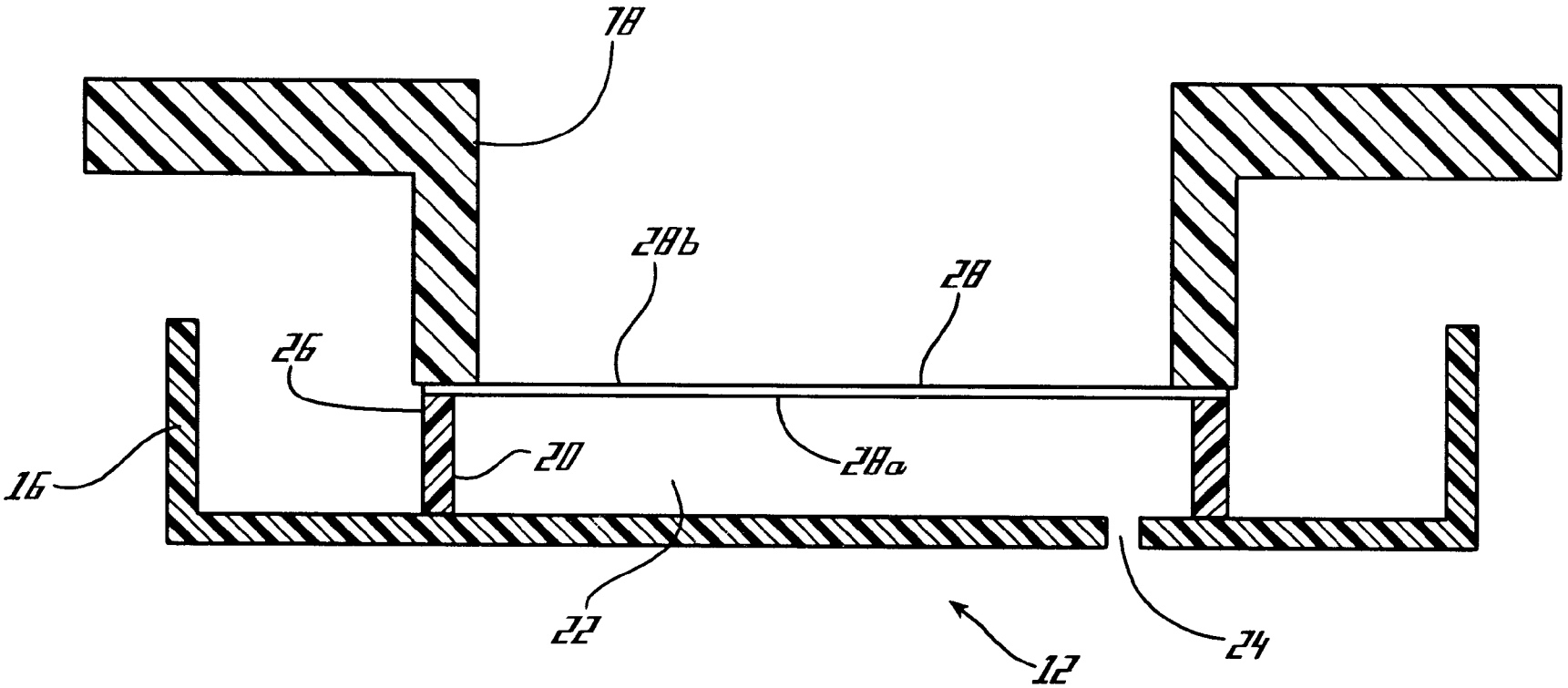
FIG. 9 is a cross-sectional view, not to scale, of masking device applied to a frame of an ink cartridge during manufacture of a pressure control device according to the invention.

After attaching the web 28 to the peripheral edge 26 of frame 20, the web is preferably substantially conformed to the cavity 22 to maximize the pressure response of the pressure control device. In order to conform the web 28 to the cavity 22, a thermal masking device 78 is attached adjacent the peripheral edge 26 of the frame 20 with the web 28 between peripheral edge 26 and the masking device 78 as shown in FIG. 9. It is preferred to use a thermal masking device 78 during the web conforming step in order to prevent or reduce deformation or irregularities of the flexible web 28 adjacent the peripheral edge 26 of inner frame 20 which may be induced by the web deformation step, as further described below. In the case of a polymeric ink cartridge 12 and frame 20, the masking device 58 may also prevent or reduce deformation or warping of the inner frame 20.

Next a differential pressure is applied to the web 28 by inducing a subatmospheric pressure in cavity 22 through the pressure port 24 before, during or while heating the flexible web 28 to a temperature sufficient to soften and mold the web 28. The induced pressure and applied heat substantially conforms web 28 to the cavity 22, thereby creating a variable volume of the cavity 22 having a substantially predictable pressure-volume relationship. Methods used to heat the flexible web 28 to conform the web 28 to the cavity 22 during the pressure forming step include, for example, an infrared light, heat lamp or hot air. There are a variety of methods for inducing a pressure differential in cavity 22 and those skilled in the art will realize that the invention is not intended to be limited to the specific disclosures herein.

Because of the application of a subatmospheric pressure or pressure differential on web 28 during the heating step, a shim is not required to depress the web 28 during heat application to the web 28. The web 28 conformed to the cavity 22 by heat and pressure is essentially free of wrinkles and surface irregularities. Furthermore, a variable volume of the ink cavity 18 having a substantially predictable pressure-volume relationship is provided due to the substantially uniformly conformed web 28. Since the cavity 22 volume is substantially predictable, hysteresis and back-pressure variations are substantially minimized, resulting in uniform ink spot size and improved print quality characteristics.

For a web 28 made of polypropylene film having a thickness of about 3 mils, it is preferred to heat the web 28 for about 4.5 seconds at about 150° C. while applying a subatmospheric pressure to cavity 22 of about 25 inches of mercury for about five seconds. Other web materials may require longer or shorter heating and pressure times, higher or lower temperatures and higher or lower pressures. However, for a wide variety of thermoplastic polymeric materials having properties similar to polypropylene, the foregoing times, temperatures and pressures are sufficient to achieve the purposes of the invention.

Prior to filling the ink cavity 18 with ink, the rigid cover 36 is attached to the outer frame 16 to provide a fluid tight cavity 18. The cavity 18 is maintained at substantially atmospheric pressure and the web 28 is held in conformance to the cavity 22 by biasing member 34. Ink is then introduced into ink cavity through ink supply port 38 (FIG. 2) to fill the cavity 18 with ink. After filling the cavity 18 with ink, a portion of the ink is removed from the ink cavity 18 to provide an initial subatmospheric pressure ranging from about 2 to about 4 inches of water column in cavity 18. As the volume of ink in cavity 18 decreases due to printing operations, web 28 moves toward cover 36. Biasing member 34 resists movement of plate 32 toward cover 36 thereby maintaining a substantially constant pressure in ink cavity 18 ranging from about negative 2 to about negative 8 inches water.

It is contemplated, and will be apparent to those skilled in the art from the preceding description and the accompanying drawings, that modifications and changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A method for manufacturing a pressure control device for an ink jet cartridge, the method comprising the steps of providing a thermoplastic, flexible web having an edge portion, a first side and a second side, providing a substantially inflexible frame member having at least one peripheral edge, disposing the first side of the flexible web adjacent the peripheral edge of the frame and heat welding the edge portion of the web and peripheral edge of the frame to one another using a heated platen, the heated platen having a heating surface and the peripheral edge having a bonding surface, the heat welding step being conducted with a structure selected from the group consisting of an angled platen for heat welding the flexible web and peripheral edge, a conventional platen for heat welding an angled peripheral edge and an angled platen for heat welding an angled peripheral edge whereby a bond is formed between the flexible web and the bonding surface at a temperature and a pressure which minimizes thinning of the flexible web on the bonding surface at least adjacent the substantially closed cavity and wherein an angle providing the angled platen or angled peripheral edge relative to a plane defined by the flexible web ranges from about 5 to about 45 degrees.

2. The method of claim 1 further comprising providing biasing means adjacent the first or second side of the web to bias the web relative to the cavity during ink use and refilling, wherein the biasing means is selected from the group consisting of leaf springs, coil springs, resilient foam and a fluid pressure source.

3. The method of claim 2 wherein the biasing means is adjacent the first side of the flexible web.

4. The method of claim 2 wherein the biasing means is adjacent the second side of the flexible web.

5. The method of claim 1 wherein the flexible web comprises a polymeric laminate material.

6. The method of claim 1 wherein the heating surface of the platen is angled with an angle ranging from about 10 to about 30 degrees with respect to the plane defined by the flexible web.

7. The method of claim 1 wherein the bonding surface on the peripheral edge is angled with an angle ranging from about 10 to about 30 degrees with respect to the plane defined by the flexible web.

8. The method of claim 1 wherein the bonding surface on the peripheral edge and the heating surface of the platen both angled wherein the sum of the angles ranges from about 10 to about 30 degrees with the individual angles being with respect to the plane defined by the flexible web.

9. The method of claim 1, wherein the flexible web is comprised of laminar layers of material selected from the group of polymeric materials consisting of polyvinylidene chloride, polyethylene, polypropylene, polyamide, and polyethylene teraplithalate, and combinations of two or more of the foregoing, as well as metallized films and silicon oxide coated films made from the foregoing polymeric materials.

10. An ink jet pen for use in an ink jet printer, the pen including an ink jet cartridge body and ink jet cartridge attached to the cartridge body, the ink jet cartridge containing ink and having a pressure control device disposed therein for maintaining a substantially constant pressure in the ink jet cartridge, the ink jet cartridge comprising:

a substantially inflexible frame having at least one peripheral edge; and at least one thermoplastic, flexible web having an edge portion, a first side and a second side, the edge portion of the first side being heat welded to the peripheral edge of the frame thereby defining a substantially closed cavity, wherein edge the portion and the peripheral edge are heat welded to one another at a temperature and a pressure sufficient to provide a reinforced web edge portion and wherein the heat welded flexible web is provided by a heat welding structure selected from the group consisting of an angled platen for heat welding the flexible web and the peripheral edge, a conventional platen for heat welding an angled peripheral edge and an angled platen for heat welding an angled peripheral edge and wherein an angle providing the angled platen or the angled peripheral edge relative to a plane defined by the flexible web ranges from about 5 to about 45 degrees.

11. The ink jet pen of claim 10 further comprising biasing means adjacent the first or second side of the flexible web wherein the biasing means is selected from the group consisting of leaf springs, coil springs, resilient foam and a fluid pressure source.

12. The ink jet pen of claim 11 wherein the biasing means is adjacent the first side of the flexible web.

13. The ink jet pen of claim 11 wherein the biasing means is adjacent the second side of the flexible web.

14. The ink jet pen of claim 10 wherein the ink is contained within the substantially closed cavity.

15. The ink jet pen of claim 10 wherein the ink is external to the substantially closed cavity.

16. The ink jet pen of claim 10 wherein the flexible web comprises a polymeric laminate.

17. The ink jet pen of claim 10 wherein the flexible web is comprised of laminar layers of material selected from the group of polymeric materials consisting of polyvinylidene chloride, polyethylene, polypropylene, polyamide, and polyethylene teraplithalate, and combinations of two or more of the foregoing, as well as metallized films and silicon oxide coated films made from the foregoing polymeric materials.

18. The ink jet pen of claim 10 wherein the heat welding structure comprises the angled platen having a heating edge angled from about 10 to about 30 degrees relative to the plane defined by the flexible web.

19. The ink jet pen of claim 10 wherein the heat welding structure comprises a peripheral edge having an angle ranging from about 10 to about 30 degrees relative to the plane defined by the flexible web.

20. The ink jet pen of claim 10 wherein the heat welding structure comprises a peripheral edge having angle ranging from about 5 to about 15 degrees relative to the plane defined by the flexible web and an angled platen having a heating edge angled from about 5 to about 15 degrees relative to the plane defined by the flexible web.

21. An ink jet cartridge for an ink jet printer, the ink jet cartridge comprising:

a substantially inflexible frame having at least one peripheral edge; and at least one thermoplastic, flexible web having an edge portion, a first side and a second side, the edge portion of the first side being heat welded to the peripheral edge of the frame thereby defining a substantially closed cavity, wherein the heat welded flexible web is provided by a heat welding structure selected from the group consisting of an angled platen for heat welding the flexible web and the peripheral edge, a conventional platen for heat welding an angled peripheral edge and an angled platen for heat welding an angled peripheral edge and wherein an angle providing the angled platen or the angled peripheral edge relative to a plane defined by the flexible web ranges from about 5 to about 45 degrees so as to provide a reinforced web edge portion.

22. The ink jet cartridge of claim 21 wherein the flexible web comprises a polymeric laminate.

23. The ink jet cartridge of claim 21 further comprising biasing means adjacent the first or second side of the flexible web to bias the web relative to the cavity, wherein the biasing means is selected from the group consisting of a leaf springs, coil springs, resilient foam and a fluid pressure source.

24. The ink jet cartridge of claim 23 wherein the biasing means is adjacent the first side of the flexible web.

25. The ink jet cartridge of claim 23 wherein the biasing means is adjacent the second side of the flexible web.

26. The ink jet cartridge of claim 21 wherein the flexible web is comprised of laminar layers of material selected from the group of polymeric materials consisting of polyvinylidene chloride, polyethylene, polypropylene, polyamide, and polyethylene teraplithalate, and combinations of two or more of the foregoing, as well as metallized films and silicon oxide coated films made from the foregoing polymeric materials.

27. The ink jet cartridge of claim 21 wherein the heat welding structure comprises the angled platen having a heating edge angled from about 10 to about 30 degrees relative to the plane defined by the flexible web.

28. The ink jet cartridge of claim 21 wherein the heat welding structure comprises a peripheral edge having an angle ranging from about 10 to about 30 degrees relative to the plane defined by the flexible web.

29. The ink jet cartridge of claim 21 wherein the heat welding structure comprises a peripheral edge having an angle ranging from about 5 to about 15 degrees relative to the plane defined by the flexible web and an angled platen having a heating edge angled from about 5 to about 15 degrees relative to the plane defined by the flexible web.

* * * * *